US005752848A

United States Patent [19]

Youngmark

[11] Patent Number: 5,752,848

[45] Date of Patent: May 19, 1998

[54] ELECTRICAL CORD CONNECTION RETAINING DEVICE

[75] Inventor: John D. Youngmark, Stanchfield, Minn.

[73] Assignee: John Douglas Youngmark, Stanchfield, Minn.

[21] Appl. No.: 697,532

[22] Filed: Aug. 26, 1996

[51] Int. Cl.[6] ..... H01R 13/62

[52] U.S. Cl. ..... 439/369; 24/155 H; 24/129 R; 439/371

[58] Field of Search ..... 439/369, 374; 24/30.5, 129 D, 129 R, 115 H

[56] References Cited

U.S. PATENT DOCUMENTS

| | | | |
|---|---|---|---|
| 2,725,543 | 11/1955 | Tanner | 439/369 |
| 3,475,716 | 10/1969 | Laig | 439/369 |
| 4,097,105 | 6/1978 | Zumwalt | 436/369 |
| 4,440,465 | 4/1984 | Elliott et al. | 439/369 |
| 4,514,026 | 4/1985 | Herbert | 439/297 |
| 4,898,542 | 2/1990 | Jones, Jr. | 439/369 |
| 4,957,450 | 9/1990 | Pioszak | 439/369 |

FOREIGN PATENT DOCUMENTS

| | | | |
|---|---|---|---|
| 149560 | 8/1920 | United Kingdom | 24/30.5 |

*Primary Examiner*—Gary F. Paumen
*Assistant Examiner*—Katrina Davis
*Attorney, Agent, or Firm*—Leo Gregory; Reif and Gregory

[57] ABSTRACT

A strap like device retaining the connected terminals of a pair of electrical cords from becoming unintentionally separated.

6 Claims, 3 Drawing Sheets

ELECTRICAL CORD CONNECTION RETAINING DEVICE

Reference is made to applicants previous application Ser. No. 033,360 allowed Aug. 18, 1993, and abandoned.

BACKGROUND OF THE INVENTION

1. Field of the Invention

This invention relates to a device to prevent the separation of connected terminals of electrical cords.

2. Brief Description of the Prior Art

In using a tool powered from an electrical source such as a drill, welder, grinder and the like, the tool generally has a cord of limited length which must be connected with the terminal of a cord running to a power source to have a sufficient cord length for working purposes.

In working with the tools and moving about with them, there is frequently a separation of the coupled cords at their connected terminals. Makeshift tying means such as string or tape or intertwining the cords is used in an effort to prevent the separation of the cord terminals.

SUMMARY OF THE INVENTION

This invention relates to a relatively small conveniently handled device for retaining together the connected terminals of a pair of electrical cords.

The device herein is a wrapper or a strap like retainer made of a flexible, stretchable, tear resistant appropriate material which is particularly formed when wound about a pair of terminals to become a locked retainer for preventing the separation of the coupled terminals.

More specifically, the device herein relates to a flexible material strap-like wrapper having an end portion thereof adapted to overlie one terminal of a pair of connected electrical cords having an end portion of reduced width extending through a pair of slots in an adjacent portion thereof and the other end portion thereof is brought over and around the other connected terminal to overlie the portion first overlying said first mentioned terminal and being secured thereto by a button fastener, said first end portion may have an extension thereof having perforations therein to receive and retain a key member such as may be used with a power drill.

These and other objects and advantages of the invention will be set forth in the following description made in connection with the accompanying drawings.

DESCRIPTION OF A PREFERRED EMBODIMENT

Figures 1, 2:
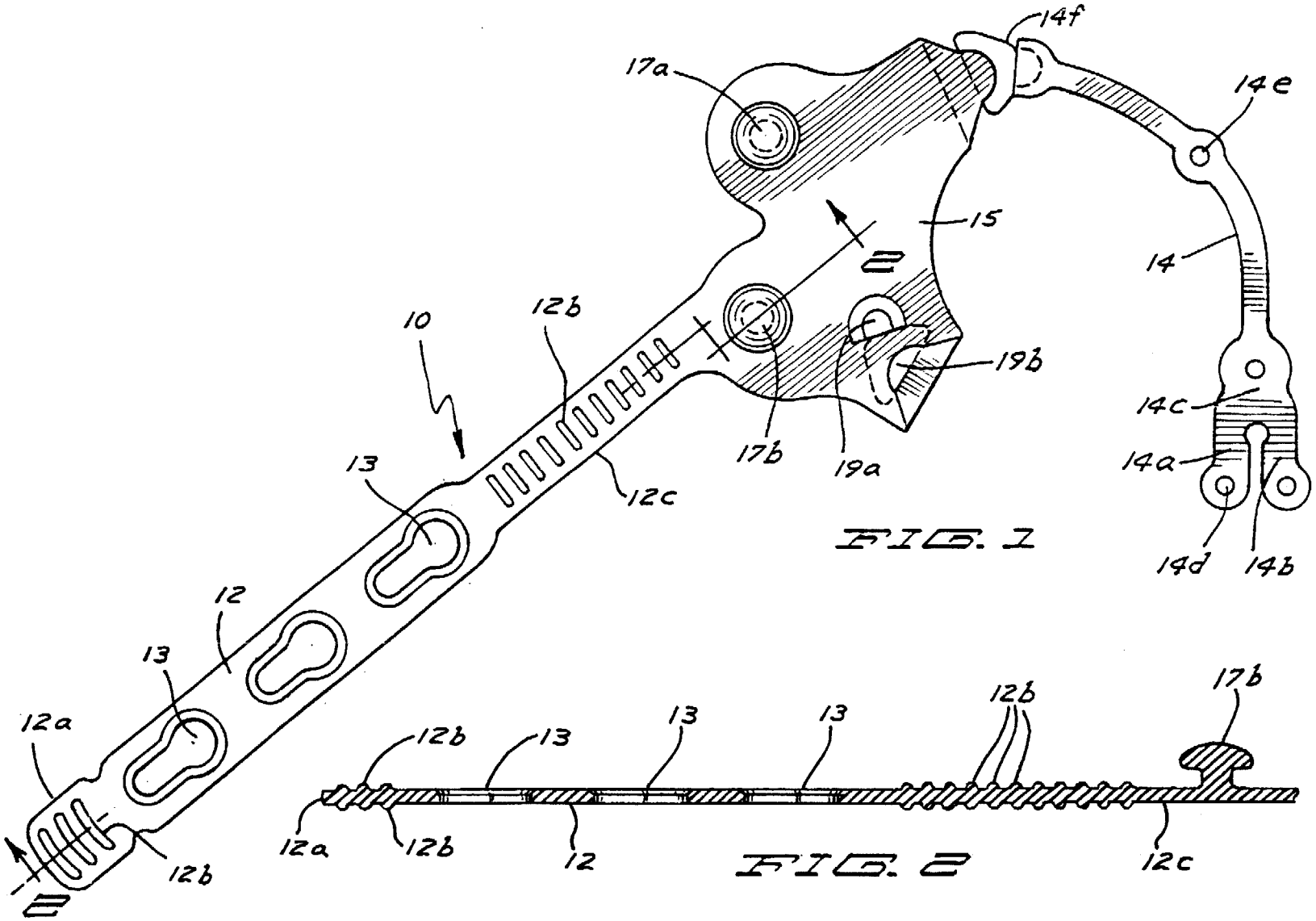
FIG. 1 is a top plan view of the device herein in extended form.
FIG. 2 is a view in vertical section taken on line 2—2 of FIG. 1 as shown.

With reference to the drawings and more particularly to FIG. 1, the device herein is indicated generally by the reference numeral 10. The device is strap-like in general form having an extended strap portion 12, a shorter strap portion 14 and a widened irregular shaped intermediate portion 15 therebetween. The strap portion 12 has a plurality of key hole apertures or button holes 13.

The device is made preferably of a relatively soft, resilient, stretchable, glove like material, highly resistant to tearing. A suggested commercial form of an appropriate material is known under the trade name of SANTOPRENE, the same being a composition of plastic and rubber.

The strap portion 12 has a terminal portion **12*a* which has a plurality of spaced transverse ridges 12*b* theron at each side thereof and having a narrowed stretchable extended portion 12*c* adjacent the intermediate portion 15 and which as shown, also has a plurality of transverse ridges 12*b*** at each side thereof.

The intermediate portion 15 widens inwardly from adjacent the end portion 12 and narrows adjacent its connection with the end **14*f* of the strap portion 14 and further has thereon in spaced relation on its reverse side as indicated a pair of molded buttons 17*a* and 17*b* to have secured thereto the end portion 12 by means of the key hole button holes 13 as will be described. Spaced across the width of the intermediate portion 15 opposite the button 17*a* are a pair of spaced slots 19*a* and 19*b***.

The strap portion 14 has a molded connection with the intermediate portion 15 and is shown having a widened bifurcated outer end portion **14*c* having separated end portions 14*a* and 14*b* being apertured at 14*d* as shown and another aperture 14*e* is shown centrally of said strap 14**.

As here illustrated and in following progressively through the FIGS. 3–7, the use of the device will be described in connection with one electric power cord 20 having a terminal 21 and a second power cord 22 having a terminal 23. The terminals are shown to be connected.

Figure 3:
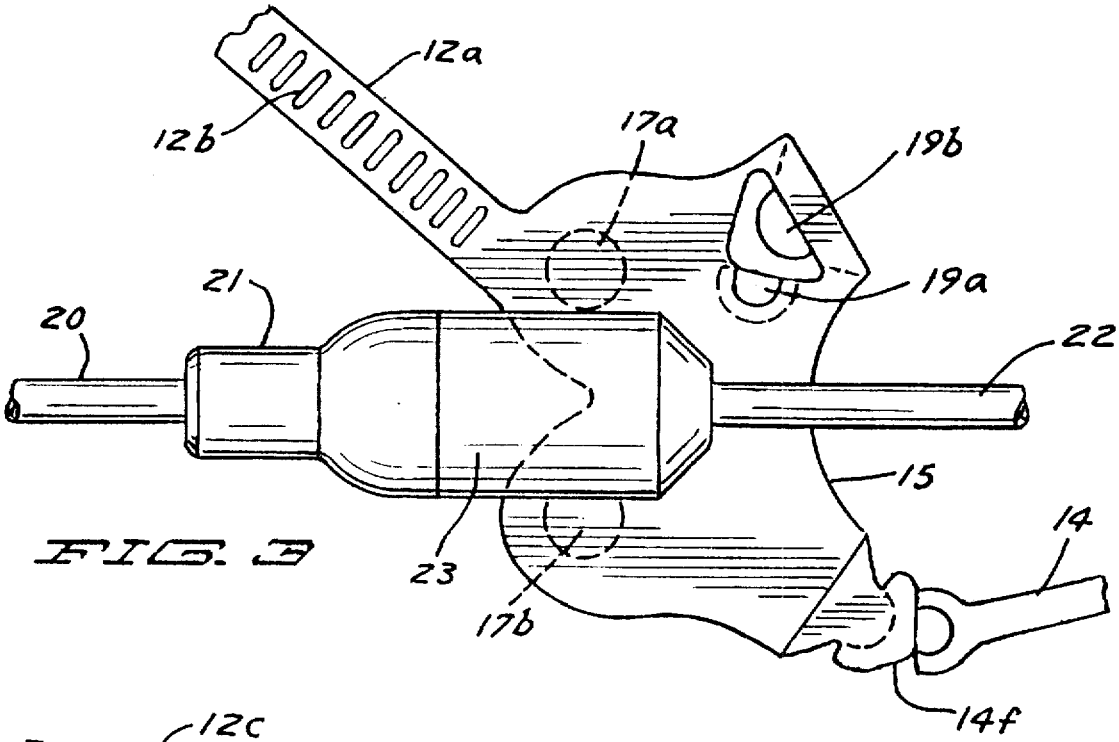
FIGS. 3–7 are broken perspective views of the device showing in progressive steps the device being wrapped about a pair of terminals securing the same from separation.
Figure 4:
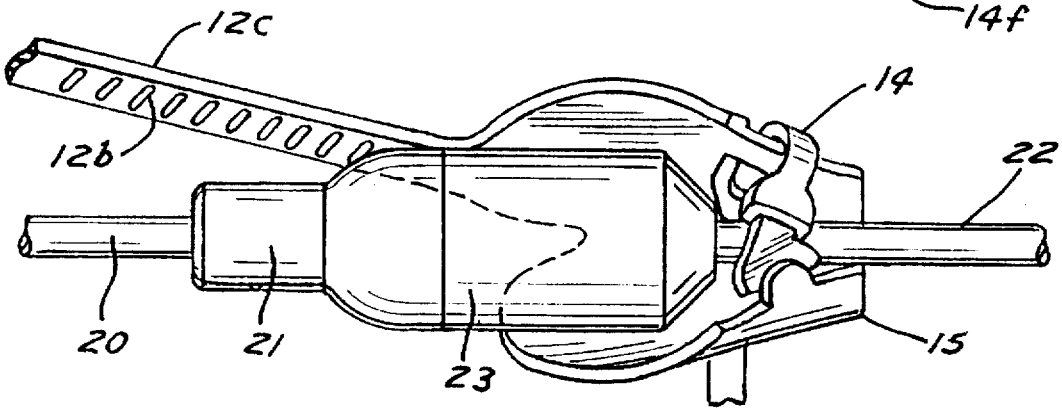
Figure 5:
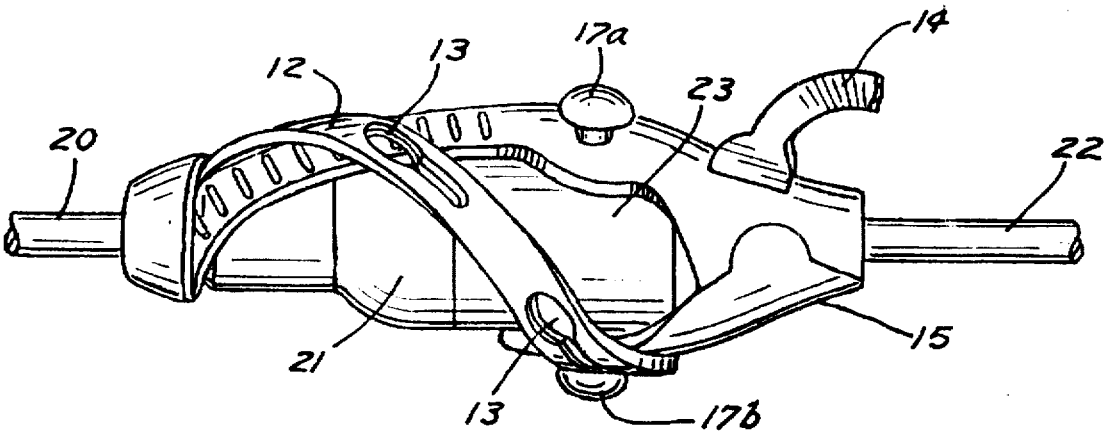
Figure 6:
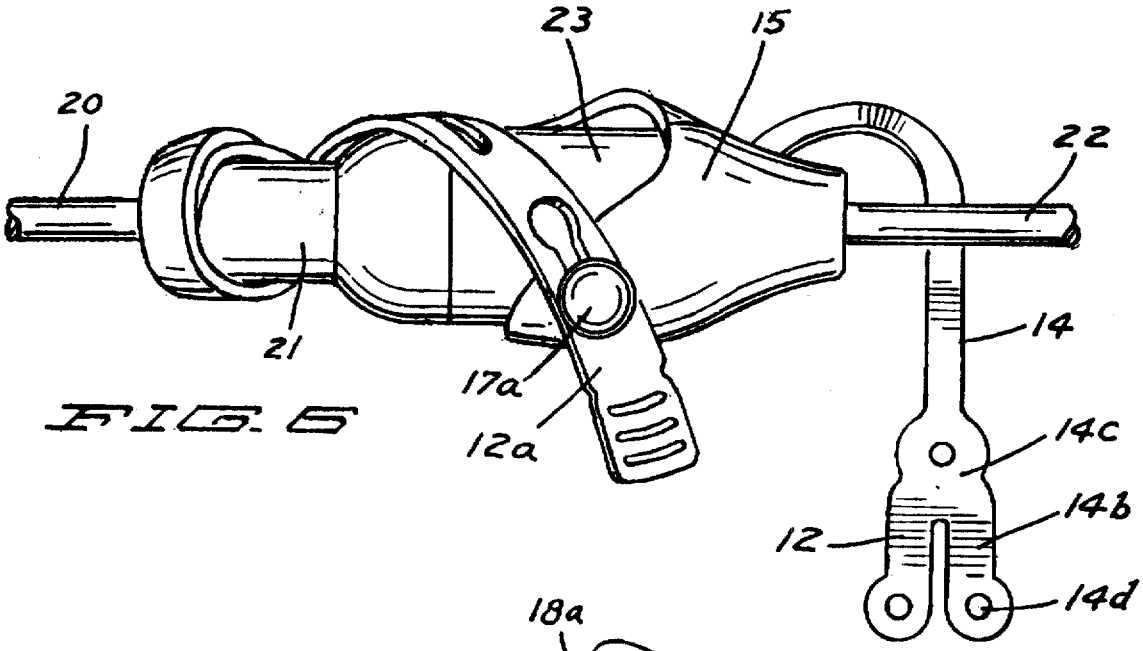
Figure 7:
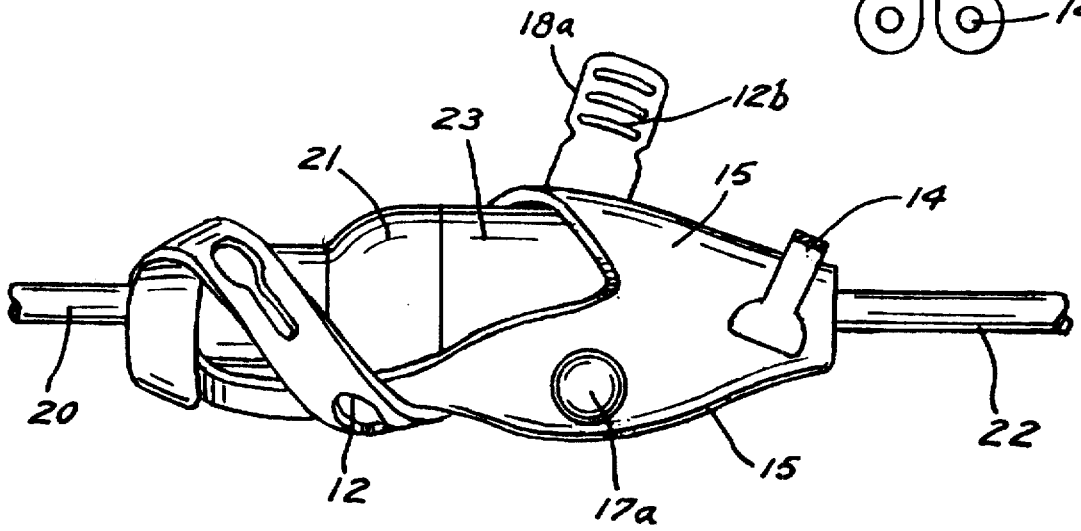

The device is taken in hand having the pair of connected terminals 21 and 23 lying partially thereon as shown in FIG. 3. Leading with its end portion, the strap 14 is extended over and about the terminal 23 and brought through the pair of slots **19*a* and 19*b*, the slots receiving therethrough the bifurcated end portion 14*c*** for a locking engagement with the strap.

The strap portion 12 is wrapped about the terminal 21 as well illustrated in steps in FIGS. 3–7 and the free end portion thereof is secured by the button holes 13 receiving therein the buttons **17*a* and 17*b***.

The strap portion 12 has transverse ridges thereon as shown and these ridges assist by interengagement of the strap portions to secure the strap 12 in holding position and assure no slippage thereof about the terminals.

Thus it is seen that in effect a completely enclosed pocket is formed by the strap about the terminals holding them secure from separation.

In the use of many hand tools, keys are provided for the operation or adjustment thereof or to secure parts thereof. The holes **14*d* and 14*e* in strap portion 14** are convenient to have keys held therein.

It is also seen that the strap 12 could readily be wrapped about an extension cord and secured as indicated to hold in storage a rolled or folded up extension cord. Many out of door tools, such as a tree sprayer may have fifty or one hundred foot length cords and the device herein performs an important service in conveniently retaining such cords in a rolled up condition for storage.

Thus there has been provided an easily operated and and applied retaining device which assures that connected electrical cords having a strain or pull placed upon them will not become unintentionally separated.

It will, of course, be understood that various changes may be made in the details, form, arrangement and proportion of the product without departing from the scope of the invention, which, generally stated, consists of a device capable of carrying out the above objects set forth as disclosed and defined in the appended claims.

What is claimed is :

1. An electrical power cord terminal retaining means, comprising a flexible strap like member having an intermediate portion and being angularly disposed to underlie a pair of connected electrical cord terminals, a first and second strap portion extending oppositely from opposed ends of said intermediate portion, said intermediate portion having securing means on one side thereof and said first strap portion having means to be secured to said securing means, said first strap portion having a plurality of slide resistant means at each end portion thereof, a pair of spaced slots in said intermediate portion remote from said securing means, said slots being adapted to receive therethrough said second strap, said second strap portion being disposed about one of said pair of terminals and through said opposed slots and having a bifurcated end portion squeezed through said slots therewith, and said first strap portion being disposed to encircle the other of said pair of connected terminals and having the free end of portion thereof secured to said securing means.

2. The structure of claim 1, wherein said securing means comprising buttons, and said strap portion having button holes therein adapted to be secured to one or more of said buttons.

3. An electrical power cord terminal retaining means, comprising a flexible strap like member having an intermediate portion and having ends having first and second strap portions of reduced width extending oppositely from each of said ends, said second strap being angled relative to said intermediate portion, securing means carried by said intermediate portion at one side thereof, said second strap having a widened bifurcated end portion, a pair of spaced slots in said intermediate portion, remote from said securing means, said slots being adapted to receive said bifurcated end portions of said second strap portion for a locking engagement therewith, said end portion being wrapped about one of a pair of connected cord terminals, said first strap being adapted to be wrapped about the other of said connected pair of said terminals and having engagement with said securing means.

4. The structure of claim 1, wherein said second strap portion being apertured to have a tool key secured therein.

5. An electrical power cord terminal retaining means, comprising a flexible strap like member having an angularly disposed intermediate portion and having a pair of ends, a first and second strap portion respectively extending oppositely from each of said ends, said intermediate portion having a plurality of securing means on one side thereof and said first strap portion having means to be secured to said securing means, a pair of spaced slots in said intermediate portion remote from said securing means, said slots being adapted to receive therethrough said second strap, said second strap portion having an end portion adapted to be received through said slots for a locking engagement, whereby said second strap portion is caused to encircle a portion of a gathered extension cord and become secured upon extending through said slots, and said first strap portion being caused to encircle the remainder of said gathered cord and become secured to said securing means.

6. The structure of claim 5, wherein said securing means of said first strap portion comprise button holes, and said securing means of said intermediate portion comprise buttons.

* * * * *